US011236688B2

(12) United States Patent
Vassallo et al.

(10) Patent No.: US 11,236,688 B2
(45) Date of Patent: Feb. 1, 2022

(54) EXHAUST THERMAL MANAGEMENT

(71) Applicant: GM Global Technology Operations LLC, Detroit, MI (US)

(72) Inventors: Alberto Lorenzo Vassallo, Turin (IT); Manuel A. Gonzalez Delgado, Turin (IT)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 40 days.

(21) Appl. No.: 16/690,737

(22) Filed: Nov. 21, 2019

(65) Prior Publication Data

US 2021/0156323 A1 May 27, 2021

(51) Int. Cl.
*F01N 11/00* (2006.01)
*F02D 41/00* (2006.01)
*F02M 26/33* (2016.01)

(52) U.S. Cl.
CPC ..... *F02D 41/0055* (2013.01); *F01N 11/00* (2013.01); *F02M 26/33* (2016.02)

(58) Field of Classification Search
CPC ..... F02D 41/0055; F02D 41/006; F02D 2041/001; F02M 26/13; F02M 26/33; F01N 11/00; Y02T 10/12; Y02T 10/40
USPC ..... 60/274, 278, 279, 287, 288
See application file for complete search history.

(56) References Cited

U.S. PATENT DOCUMENTS

2008/0092862 A1* 4/2008 Kitamura ..... F01L 1/267 123/568.14
2009/0084333 A1* 4/2009 Cleary ..... F02D 13/0207 123/90.17
2009/0301086 A1* 12/2009 Ralston ..... F02B 41/06 60/620
2010/0204903 A1* 8/2010 Nakatani ..... F02D 13/0265 701/103
2012/0167841 A1* 7/2012 Surnilla ..... F02D 37/02 123/21
2012/0204844 A1* 8/2012 Gingrich ..... F02M 26/40 123/568.11
2014/0144414 A1* 5/2014 Dean ..... F02M 26/01 123/568.14
2019/0345863 A1* 11/2019 Shipp ..... F02D 13/0249
2020/0182163 A1* 6/2020 Fujimoto ..... F02D 13/0265

* cited by examiner

*Primary Examiner* — Audrey B. Walter
*Assistant Examiner* — Dapinder Singh

(57) ABSTRACT

A method for controlling the temperature of re-circulated exhaust gas in an internal combustion engine includes operating the internal combustion engine on a base line mode, receiving a signal indicative of an engine operating temperature, wherein the engine operating temperature is one of coolant temperature, exhaust temperature and oil temperature, comparing the engine operating temperature to a predetermined IEGR threshold, when the engine operating temperature is less than the predetermined IEGR threshold, activating an IEGR mode and activating an EEVO mode, and when the engine operating temperature is greater than the first predetermined IEGR threshold, deactivating the IEGR mode and deactivating the EEVO mode.

20 Claims, 3 Drawing Sheets

EXHAUST THERMAL MANAGEMENT

INTRODUCTION

The present disclosure relates to a method of controlling the temperature of re-circulated exhaust gas in an internal combustion engine.

Re-circulated exhaust gas ("EGR") is utilized in internal combustion engines to assist in the reduction of throttling losses at low loads, to improve knock tolerance, and to reduce the level of oxides of nitrogen ("NOx") in the exhaust gas. EGR is especially important as an emissions reducer in internal combustion engines that run lean of stoichiometry and are thus prone to emitting higher levels of NOx emissions.

Internal combustion engines that include exhaust gas re-circulation systems may rely upon internal EGR (IEGR), external EGR (EEGR), or a combination of the two. EEGR involves introduction of EGR into an engine combustion chamber through an intake valve after the EGR has traveled through an external conduit from the exhaust system. IEGR involves introduction of EGR into an engine combustion chamber through an exhaust valve or an intake valve without use of an external conduit. In order to provide exhaust flow to the combustion chambers when using EEGR, a pressure differential is needed between the exhaust flow path of the engine and the location in the intake system where the exhaust gas is reintroduced. For IEGR, an intake event (i.e., expansion of the volume within the combustion chamber, such as during the intake stroke of a piston in an internal combustion engine), typically provides a suitable pressure differential.

An IEGR system may take advantage of this pressure differential by opening one or more exhaust valves during the intake event of the valve's associated cylinder. A camshaft may be configured to facilitate selective activation and deactivation of valve-timing schemes, enabling IEGR to be selectively activated and/or deactivated. Duration, timing, and valve lift (i.e., flow rate) are affected by geometry of the camshaft in cooperation with the components of the valve train. Switchable rocker arms can facilitate switching between sets of lobes on a modified camshaft to enable switching between EGR modes. For example, a variable rocker arm assembly may be actuated or switched based on oil pressure, which can be modulated by an oil control valve. As different modes are actuated, different cam lobes become active, resulting in control over timing of valve actuation and thus control over IEGR, During initial stages of engine operation following a cold start (i.e., approximately 200 seconds), before an engine reaches normal operating temperatures (e.g., coolant temperatures exceeding approximately 90 degrees C.), exhaust emissions may tend to exceed desirable or permissible levels. At relatively low exhaust temperatures, such as during engine warm-up, EEGR may negatively impact combustion stability and may also cause increased hydrocarbon (HC) emissions, IEGR is useful in a strategy for DOC heating.

Thus, while current IEGR modes achieve their intended purpose of increasing the temperature of exhaust gas, there is a need for a new and improved method of controlling the temperature of re-circulated exhaust gas in an internal combustion engine that provides improved heating of re-circulated exhaust gas over the use of IEGR alone.

SUMMARY

According to several aspects of the present disclosure, a method for controlling the temperature of re-circulated exhaust gas in an internal combustion engine includes operating the internal combustion engine on a base line mode, receiving a signal indicative of an engine operating temperature, comparing the engine operating temperature to a predetermined IEGR threshold, when the engine operating temperature is less than the predetermined IEGR threshold, activating an IEGR mode and activating an EEVO mode, and when the engine operating temperature is greater than the first predetermined IEGR threshold, deactivating the IEGR mode and deactivating the EEVO mode.

According to another aspect, the engine operating temperature is a coolant temperature.

According to another aspect, the engine operating temperature is an exhaust temperature.

According to another aspect, the engine operating temperature is an oil temperature.

According to another aspect, the base line mode includes activating a primary exhaust valve opening during an exhaust event of the exhaust valve's associated cylinder.

According to another aspect, the IEGR modes includes activating a secondary exhaust valve opening during an intake event of the exhaust valve's associated cylinder, and keeping the exhaust valve partially open between the primary exhaust valve opening and the secondary exhaust valve opening.

According to another aspect, the exhaust valve is fully opened during the primary exhaust valve opening, and the exhaust valve is less than 40% of fully opened during the secondary exhaust valve opening.

According to another aspect, the EEVO modes includes activating the primary exhaust valve opening prior to the base line primary exhaust valve opening, holding the exhaust valve fully open, and closing the exhaust valve according to the base line mode.

According to several aspects of the present disclosure, a method for controlling the temperature of re-circulated exhaust gas in an internal combustion engine includes operating the internal combustion engine on a base line mode, receiving a signal indicative of an engine operating temperature, wherein the engine operating temperature is one of coolant temperature, exhaust temperature and oil temperature, comparing the engine operating temperature to a predetermined IEGR threshold, when the engine operating temperature is less than the predetermined IEGR threshold, activating an IEGR mode and activating an EEVO mode, and when the engine operating temperature is greater than the first predetermined IEGR threshold, deactivating the IEGR mode and deactivating the EEVO mode.

According to another aspect, the base line mode includes activating a primary exhaust valve opening during an exhaust event of the exhaust valve's associated cylinder, the exhaust valve being fully opened during the primary exhaust valve opening.

According to another aspect, the IEGR modes includes activating a secondary exhaust valve opening during an intake event of the exhaust valve's associated cylinder, the exhaust valve being less than 40% fully opened during the secondary exhaust valve opening, and keeping the exhaust valve partially open between the primary exhaust valve opening and the secondary exhaust valve opening.

According to another aspect, the EEVO modes includes activating the primary exhaust valve opening prior to the base line primary exhaust valve opening, holding the exhaust valve fully open, and closing the exhaust valve according to the base line mode.

According to several aspects of the present disclosure, an internal combustion engine includes at least one combustion cylinder, at least one exhaust valve adapted to allow combustion gases to be exhausted from the combustion cylinder, and a cam shaft including cam lobes adapted to control the at least one exhaust valve, the cam shaft further adapted to selectively operate the at least one exhaust valve in at least one of a base line mode, an IEGR mode and an EEVO mode.

According to another aspect, the internal combustion engine further includes a control module, the control module adapted to receive a signal indicative of an engine operating temperature and operate the internal combustion engine in the base line mode when the engine temperature exceeds a predetermined IEGR threshold, and to operate the internal combustion engine in both the IEGR mode and the EEVO mode when the engine temperature is less than the predetermined IEGR threshold.

According to another aspect, the engine operating temperature is a coolant temperature.

According to another aspect, the engine operating temperature is an exhaust temperature.

According to another aspect, the engine operating temperature is an oil temperature.

According to another aspect, when operating in the base line mode, the cam shaft is adapted to actuate a primary exhaust valve opening, by fully opening the exhaust valve, during an exhaust event of the exhaust valve's associated cylinder.

According to another aspect, when operating in the IEGR mode, the cam shaft is adapted to actuate a secondary exhaust valve opening, by opening the exhaust valve less than 40% of fully opened, during an intake event of the exhaust valve's associated cylinder, and to hold the exhaust valve partially open between the primary exhaust valve opening and the secondary exhaust valve opening.

According to another aspect, when operating in the EEVO mode, the cam shaft is adapted to actuate the primary exhaust valve opening prior to the base line primary exhaust valve opening, hold the exhaust valve fully open, and close the exhaust valve according to the base line mode.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
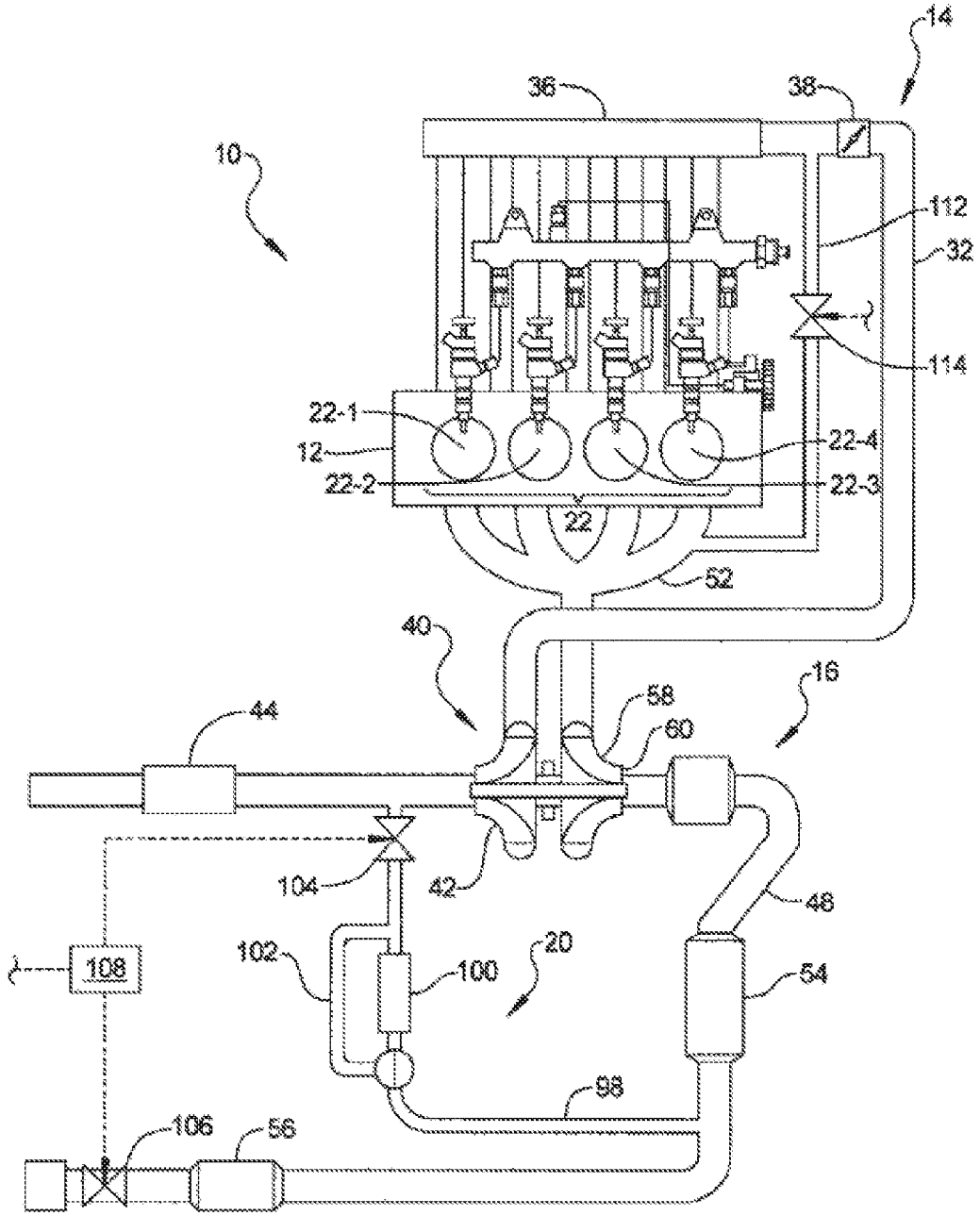
FIG. 1 is a schematic view of an internal combustion engine in accordance with an exemplary embodiment of the present disclosure.
Figure 2:
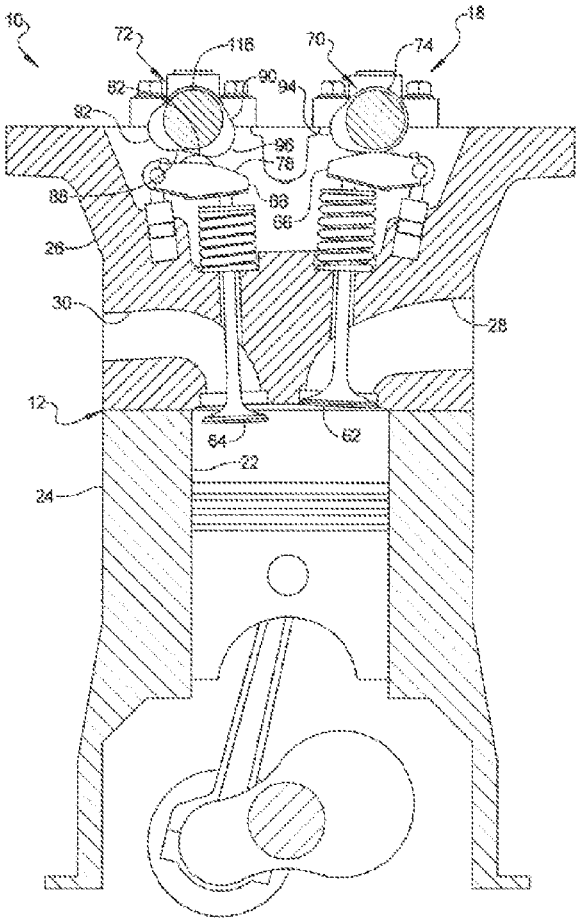
FIG. 2 is a side sectional view of a cylinder of the internal combustion engine shown in FIG. 1.

Referring to FIG. 1 and FIG. 2, in an exemplary embodiment, an internal combustion engine assembly 10 includes an engine structure 12, an intake system 14, an exhaust system 16, a valvetrain assembly 18, and an exhaust gas re-circulation (EGR) assembly 20. The engine structure 12 comprises an engine block 24 coupled to a cylinder head 26 to define cylinders 22, which form combustion chambers. The cylinder head 26 defines intake ports 28 and exhaust ports 30 in communication with the combustion chambers.

As shown schematically in FIG. 1, the engine assembly 10 defines four cylinders 22-1, 22-2, 22-3, 22-4. For simplicity, only a single representative cylinder 22 is illustrated in the section view shown in FIG. 2; however, the features and aspects discussed relative to the cylinder 22 shown in FIG. 2 are equally relevant to the remaining cylinders 22. Additionally, it is understood that the present teachings apply to any number of piston-cylinder arrangements and a variety of reciprocating engine configurations including, but not limited to, V-engines, inline engines, and horizontally opposed engines, as well as both overhead cam and cam-in-block configurations.

In an exemplary embodiment, the intake system 14 includes an intake runner 32, an intake manifold 36 that is coupled to the cylinder head 26 and in fluid communication with the intake runner 32, and an intake throttle valve 38 disposed in the intake runner 32. The intake throttle valve 38 may be configured for one or more purposes including: (a) airflow control, (b) pressure differential across a short-route EGR cooler, (c) smooth engine shutoff, (d) management of EGR flow rate, and/or (e) controlling a rate of flow of intake air to intake ports 28 through the intake manifold 36. The intake system 14 also includes a turbocharger 40 including an intake side 42 (compressor) located in the intake runner 32 and an air cleaner 44 located in the intake runner 32. The intake runner 32 may define an air inlet into the intake system 14, and the turbocharger 40 may be in communication with the intake ports 28 via the intake manifold 36. While a single turbocharger 40 is illustrated, it is understood that the present disclosure applies equally to arrangements including multiple turbochargers.

The exhaust system 16 may include an exhaust conduit 48, an exhaust manifold 52 coupled to the cylinder head 26 and in communication with the exhaust conduit 48, a diesel particulate filter (OFF) 54, and a selective catalytic reduction (SCR) catalyst 56 located in the exhaust conduit 48. While illustrated as including an individual OFF 54 and an individual SCR catalyst 56, it is understood that the present disclosure is not limited to such arrangements. The DPF 54 may alternatively be included in a combined DPF/SCR catalyst. Further, the SCR catalyst 56 may alternatively be located upstream of the OFF 54 or an additional SCR catalyst (not shown) may be included upstream of the OFF 54. An exhaust side 58 (turbine) of the turbocharger 40 may be located in the exhaust conduit 48 and may include a turbine wheel in communication with and driven by exhaust gas flowing through the exhaust conduit 48. The exhaust side 58 of the turbocharger 40 may include a variable exhaust gas outlet 60 that controls an exhaust gas flow restriction through the turbocharger 40. The variable exhaust gas outlet 60 may be in the form of a variable nozzle.

As seen in FIG. 2, the valvetrain assembly 18 may include intake valves 62 located in the intake ports 28, exhaust valves 64 located in the exhaust ports 30, intake valve lift mechanisms 66 supported on the cylinder head 26 and engaged with the intake valves 62, exhaust valve lift mechanisms 68 supported on the cylinder head 26 and engaged with the exhaust valves 64, an intake camshaft 70 supported for rotation on the cylinder head 26 and engaged with the intake valve lift mechanisms 66 and an exhaust camshaft 72 supported for rotation on the cylinder head 26 and engaged with the exhaust valve lift mechanisms 68. The intake camshaft 70 may include intake cam lobes 74 engaged with each of the intake valve lift mechanisms 66. The intake camshaft 70 may include an intake cam phaser (not shown) and the intake valve lift mechanisms 66 may take a variety of forms including, but not limited to, conventional or variable valve lift mechanisms.

In one exemplary embodiment, the exhaust valve lift mechanisms 68 may form hydraulically actuated deactivating valve lift mechanisms operable in a plurality of modes, such as a base line mode, an EGR mode and an EEVO mode. In another exemplary embodiment, the exhaust valve lift mechanisms 68 may form electromechanically actuated mechanisms, such as a sliding camshaft system for valve profile switching. In the present non-limiting example, the exhaust valve lift mechanisms 68 may be in the form of a rocker arm including a pair of outer arms 78, an inner arm, including a roller 82 and a locking mechanism selectively coupling the outer arms 78 to the inner arm. The locking mechanism may be switched between locked and unlocked positions by a pressurized fluid supply. The locking mechanism may secure the outer arms 78 for displacement with the inner arm during a particular mode and may allow relative displacement between the outer arms 78 and the inner arm during a different mode.

The exhaust camshaft 72 may include EGR cam lobes 88 engaged with each of the outer arms 78 and exhaust cam lobes 90 located between pairs of EGR cam lobes 88 and engaged with the inner arm. Each of the EGR cam lobes 88 may define an EGR lift region 92 at least partially rotationally aligned with an intake lift region 94 defined by a corresponding one of the intake cam lobes 74. The exhaust cam lobes 90 may define exhaust lift regions 96 rotationally offset from the EGR lift region 92 and the intake lift region 94.

The EGR assembly 20 may include an EGR line 98, an EGR cooler 100 and cooler bypass 102 located in the EGR line 98, an EGR control valve 104 and a backpressure control valve 106. The EGR line 98 may extend from the exhaust conduit 48 at a location between the turbocharger 40 and an outlet of the exhaust conduit 48 to the intake system 14 to provide communication between the intake system 14 and the exhaust system 16.

In the non-limiting example shown in FIG. 1, the EGR control valve 104 may be located at the outlet of the EGR line 98 and may control exhaust gas re-circulation flow to the intake system 14 from the EGR line 98. A backpressure control valve 106 may be located in the exhaust conduit 48 at a location between the EGR line 98 and an outlet of the exhaust conduit 48. In the non-limiting example shown in FIG. 1, the backpressure control valve 106 is located at the outlet of the exhaust conduit 48. The DPF 54 may be located in the exhaust conduit 48 at a location between the exhaust side 58 of the turbocharger 40 and the backpressure control valve 106. The arrangement discussed above provides an IEGR system in combination with a low pressure EGR system.

The engine assembly 10 may additionally include a control module 108 in communication with the EGR control valve 104 and the backpressure control valve 106. The pressurized fluid supply for the exhaust valve lift mechanisms 68 may include oil control valves in communication with and controlled by the control module 108. It should be noted that the intake throttle valve 38 may also be in communication with the control module 108.

The backpressure control valve 106 may be used to control the pressure differential between the intake system 14 and the exhaust system 16 for both the IEGR system and the low pressure EGR system to adjust re-circulation of exhaust gas in the engine assembly 10. The exhaust valve lift mechanisms 68 and the EGR control valve 104 may be adjusted by the control module 108 to provide a desired amount of exhaust gas re-circulation during engine operation. The intake throttle valve 38 and the variable exhaust gas outlet 60 of the turbocharger 40 may also be used to control the pressure differential between the intake system 14 and the exhaust system 16 to further adjust the amount of exhaust gas re-circulated in the engine assembly 10. In some arrangements, the EGR assembly 20 may additionally include a bypass passage 112 and a bypass valve 114 located in the bypass passage 112 and in communication with the control module 108. The bypass passage 112 may extend from the exhaust manifold 52 to a region of the intake runner 32 located between the intake throttle valve 38 and the intake manifold 36 to provide further control of exhaust gas re-circulation.

The EGR lift region 92 of the EGR cam lobes 88 provides internal exhaust gas re-circulation. The IEGR system may be used as the high pressure EGR system, eliminating the typical high pressure EGR lines and cooler and the potential for high pressure EGR cooler fouling.

As seen in FIG. 2, the lift regions 92, 94, 96 may generally be defined as regions of the cam lobes 74, 88, 90 including lobe peaks that extend from a base circle region to provide valve lift. The exhaust valve 64 may be displaced to an open position when the peak of the exhaust cam lobes 90 engage the exhaust valve lift mechanisms 68. The exhaust valve 64 may be displaced to an open position when the peaks of the EGR cam lobes 88 engage the exhaust valve lift mechanisms 68 during the IEGR mode. The EGR cam lobes 88 may provide internal exhaust gas re-circulation when the exhaust valve lift mechanisms 68 are operated in the IEGR mode.

The engine assembly includes first EGR cam lobes 88 and first exhaust cam lobes 90 engaged with first exhaust valve lift mechanisms 68 for each of the cylinders 22-1, 22-2, 22-3, 22-4.

Figure 3:
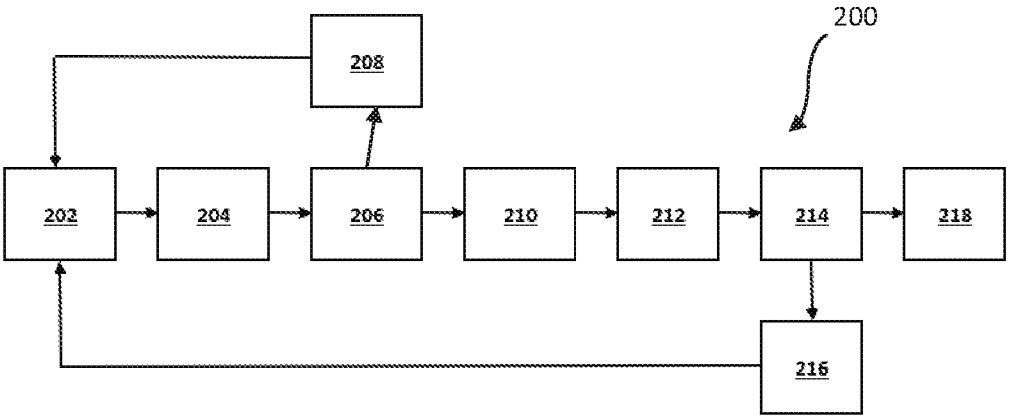
FIG. 3 is a schematic flow chart of a method according to an exemplary embodiment.
Figure 4:
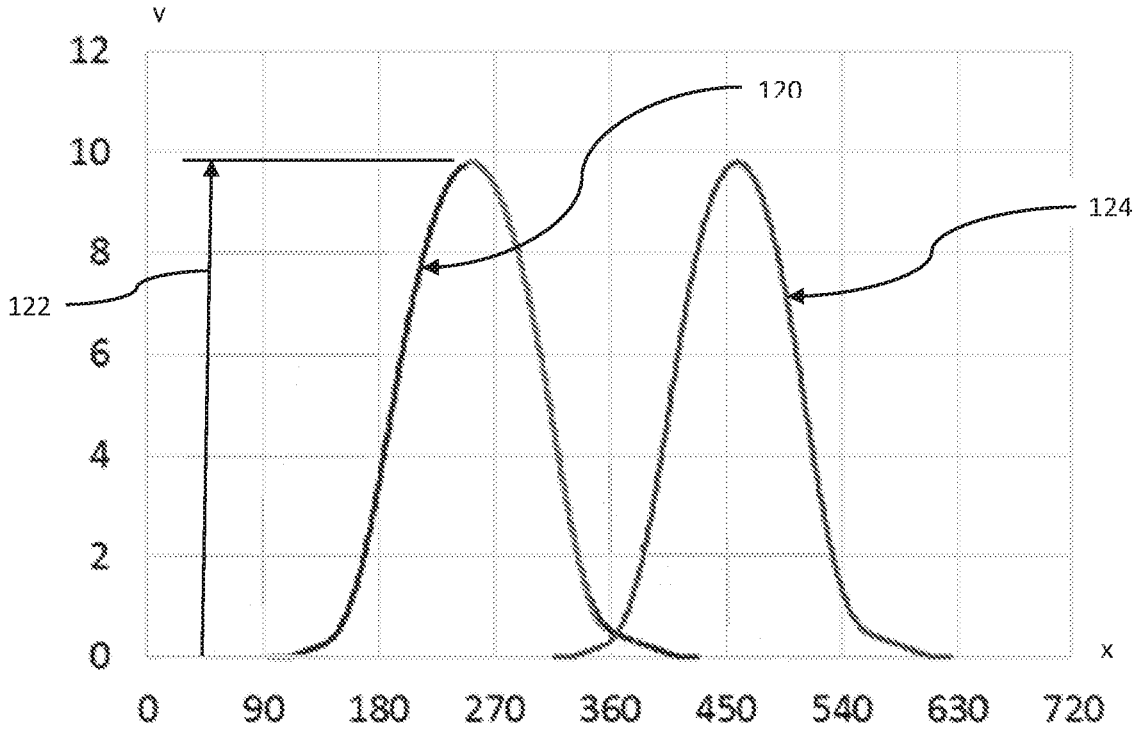
FIG. 4 is a graphical representation of a base line mode of operation according to an exemplary embodiment.

In an exemplary embodiment of the present disclosure, a method 200 for controlling the temperature of re-circulated exhaust gas in an internal combustion engine 10 is graphically represented in FIG. 3. Starting at block 202, the method 200 includes operating the internal combustion engine 10 on a base line mode. Referring to FIG. 4, in a non-limiting exemplary embodiment, the opening profiles for the intake valves 62 and the exhaust valves 64 of a cylinder 22 are graphically illustrated. The X-axis in FIG. 4 represents crank angle and the Y-axis represents valve lift.

The base line mode includes a primary exhaust valve opening, as indicated at 120. The primary exhaust valve opening 120 includes a gradual opening, followed by a gradual closing during an exhaust event of the exhaust valve's associated cylinder 22. During the primary exhaust valve opening 120, the exhaust valve 64 is fully opened. As shown in FIG. 3, the primary valve lift 122 of the exhaust valve 64 when fully opened is between approximately 9 mm and 10 mm. Following the exhaust event, the intake valve 62 is opened during an intake event for the associated cylinder, as indicated at 124.

Referring again to FIG. 3, and moving on to block 204, the control module 108 receives a signal indicative of an engine operating temperature. The engine operating temperature may be based on the temperature of the engine coolant, the exhaust temperature, or the engine oil temperature. Moving on to block 206, the engine operating temperature is compared to a predetermined IEGR threshold. Moving to block 208, if the engine operating temperature is greater than the predetermined IEGR threshold, no action is taken, and the base line mode of control is continued. Moving to block 210, if the engine operating temperature is less than the predetermined IEGR threshold, an IEGR mode is activated and an EEVO mode are activated.

Figure 5:
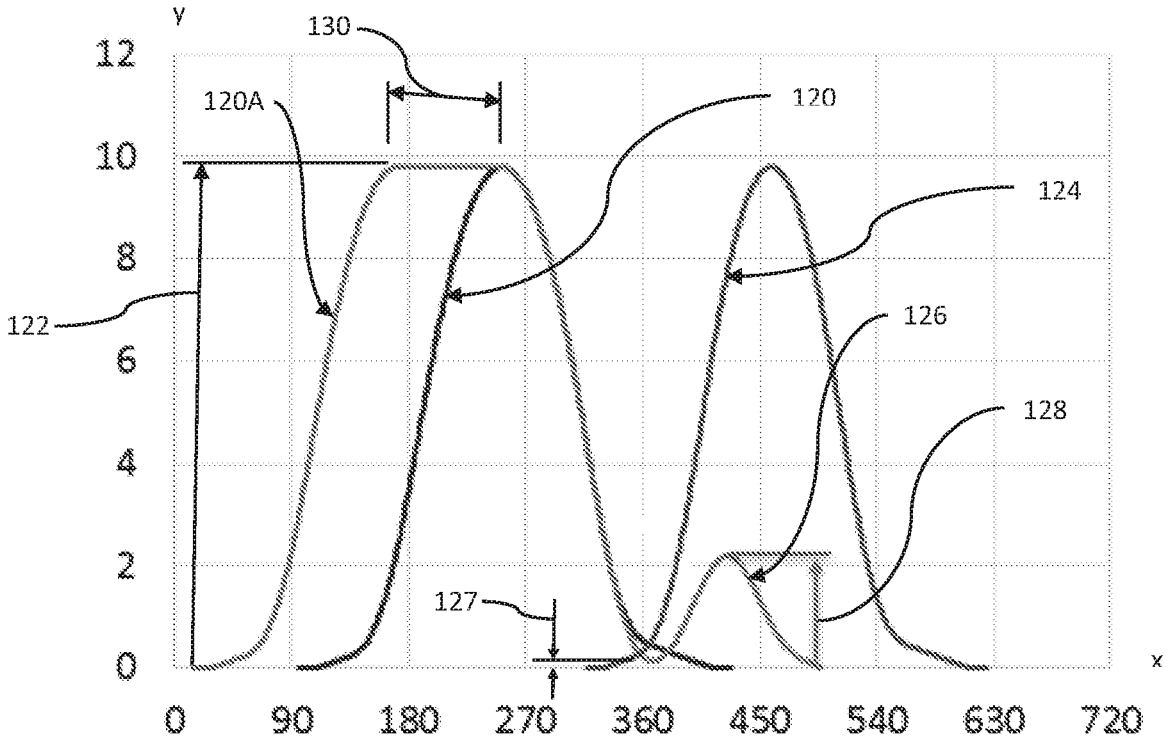
FIG. 5 is a graphical representation of an EEVO and IEGR mode of operation according to an exemplary embodiment.

Referring to FIG. 5, the IEGR modes includes activating a secondary exhaust valve opening 126, after the primary exhaust valve opening 120, during the intake event of the exhaust valve's 64 associated cylinder 22. During the secondary exhaust valve opening 126, a secondary valve lift 128 of the exhaust valve 64 is opened less than 40% of the primary valve lift 122, when the exhaust valve 64 is fully opened. In the non-limiting exemplary embodiment shown in FIG. 5, the secondary valve lift 128 of the exhaust valve 64 during the secondary exhaust valve opening 126 is between approximately 2 mm and 3 mm. IEGR increases the charge ignition energy to reduce HC and CO emissions and boosts the exhaust temperature. An entirety of the secondary exhaust valve opening 126 during the IEGR mode may occur while a corresponding intake valve 62 (i.e., intake valve for the same cylinder) is open as illustrated by the intake valve lift event 124.

In addition, the exhaust valve 64 is kept partially open between the primary exhaust valve opening 120 and the secondary exhaust valve opening 126, as indicated at 127 in FIG. 5. Not seating the exhaust valve 64 between the primary and secondary exhaust valve openings 120, 126 reduces the duration of the lift event. This increases the operational engine speed range for switching between modes and improves engine NVH characteristics at all speeds.

Referring again to FIG. 5, the EEVO modes includes activating a primary exhaust valve opening 120A prior to the base line primary exhaust valve opening 120. The exhaust valve 64 is opened early as compared to the base line mode, and is held in the fully open position until closed. During the primary exhaust valve opening 120A in the EEVO mode, the exhaust valve 64 is closed according to the same profile as the base line mode. In the non-limiting exemplary embodiment shown in FIG. 5, in the EEVO mode, the primary exhaust valve opening 120A occurs approximately 40-70 degrees earlier than the primary exhaust valve opening 120 of the base line mode, as indicated at 130 in FIG. 5.

Moving to block 212, once again, the control module 108 receives a signal indicative of an engine operating temperature. Moving on to block 214, the engine operating temperature is compared to a predetermined IEGR threshold. Moving to block 216, if the engine operating temperature is greater than the predetermined IEGR threshold, the IEGR mode and the EEVO mode are de-activated, and the base line mode is activated. Moving to block 218, if the engine operating temperature is less than the predetermined IEGR threshold, the engine continues to operate with both the IEGR mode and the EEVO mode activated.

Control over the base line, IEGR and EEVO modes is accomplished through use of engine valvetrain hardware, which causes an exhaust valve 64 to open during an intake stroke of the engine 10. Duration and timing and flow rate can all be controlled by the valve train. A variable geometry valvetrain is capable of switching between the base line mode, the IEGR and the EEVO modes. For example, a variable rocker arm assembly may be actuated based on oil pressure, which can be modulated via an oil control valve. As different modes are actuated, different cam lobes become active, resulting in different valve timing. In an exemplary embodiment, the above-described hardware may be utilized to provide an IEGR/EEVO control mode strategy that includes switching between valve profiles, variable throttling of the intake stream, control over back pressure imposed in the exhaust stream, and timed injection system events. In combination, a strategy may be devised for improving the rate at which the exhaust stream temperature achieves a desirable operating temperature as well as after-treatment conversion efficiency.

Operating in either of the IEGR mode or the EEVO mode alone provides improvements in cold-start emissions, after-treatment effectiveness, and cold-engine drivability. Other benefits may include improved fuel economy associated with reduced reliance on injection of raw fuel into the exhaust in order to warm the NOx after-treatment systems. IEGR greatly enhances the effectiveness of the warm-up modes, in-turn providing much improved warm-up emissions. Therefore, for warm-up, IEGR may be used exclusively, enabling diesel engines to achieve reduced emissions. At high loads, however, IEGR may be deactivated, facilitating smoke reduction through EEGR.

The use of IEGR and EEVO in conjunction increases exhaust gas temperature and provides HC and Nox control which enhances engine/aftertreatment system performance over that of either IEGR or EEVO alone. Synergistic effects of using EEVO and IEGR together include: 1) provides higher exhaust gas temperature, 2) improves the IEGR by increasing the temperature of the rebreathing gas due to EEVO, and 3) improves EEVO capability by increasing the in-cylinder temperature at inlet valve closing due to IEGR.

The benefits of using EEVO and IEGR together enables diesel engines to reach ultra-low emissions without the usage of very expensive aftertreatment layouts such as LNT, PNA catalysts, etc. and alternative methods for fast warm-up, such as eDOC, exhaust burners, etc.

The description of the present disclosure is merely exemplary in nature and variations that do not depart from the gist of the present disclosure are intended to be within the scope of the present disclosure. Such variations are not to be regarded as a departure from the spirit and scope of the present disclosure.

What is claimed is:

1. A method for controlling the temperature of re-circulated exhaust gas in an internal combustion engine comprising:

operating the internal combustion engine on a base line mode, including activating a primary exhaust valve opening during an exhaust event of the exhaust valve's associated cylinder;

receiving a signal indicative of an engine operating temperature;

comparing the engine operating temperature to a predetermined IEGR threshold;

when the engine operating temperature is less than the predetermined IEGR threshold, activating an IEGR mode by activating a secondary exhaust valve opening during an intake event of the exhaust valve's associated cylinder, and keeping the exhaust valve partially open between the primary exhaust valve opening and the secondary exhaust valve opening, and activating an EEVO mode; and when the engine operating temperature is greater than the first predetermined IEGR threshold, deactivating the IEGR mode and deactivating the EEVO mode.

2. The method of claim 1, wherein the engine operating temperature is a coolant temperature.

3. The method of claim 1, wherein the engine operating temperature is an exhaust temperature.

4. The method of claim 1, wherein the engine operating temperature is an oil temperature.

5. The method of claim 1, wherein the exhaust valve is fully opened during the primary exhaust valve opening, and the exhaust valve is less than 40% of fully opened during the secondary exhaust valve opening.

6. The method of claim 5, wherein the EEVO modes includes:

activating the primary exhaust valve opening prior to the base line primary exhaust valve opening;

holding the exhaust valve fully open; and closing the exhaust valve according to the base line mode.

7. A method for controlling the temperature of re-circulated exhaust gas in an internal combustion engine comprising:

operating the internal combustion engine on a base line mode by activating a primary exhaust valve opening during an exhaust event of an exhaust valve's associated cylinder, the exhaust valve being fully opened during the primary exhaust valve opening;

receiving a signal indicative of an engine operating temperature;

comparing the engine operating temperature to a predetermined IEGR threshold;

when the engine, operating temperature is less than the predetermined IEGR threshold, activating an IEGR mode by activating a secondary exhaust valve opening during an intake event of the exhaust valve's associated cylinder, the exhaust valve being less than 40% fully opened during the secondary exhaust valve opening, and keeping the exhaust valve partially open between the primary exhaust valve opening and the secondary exhaust valve opening, and activating an EEVO mode; and when the engine operating temperature is greater than the first predetermined IEGR threshold, deactivating the IEGR mode and deactivating the EEVO mode.

8. The method of claim 7, wherein the EEVO modes includes activating the primary exhaust valve opening prior to the base line primary exhaust valve opening, holding the exhaust valve fully open, and closing the exhaust valve according to the base line mode.

9. An internal combustion engine comprising:

at least one combustion cylinder;

at least one exhaust valve adapted to allow combustion gases to be exhausted from the combustion cylinder;

an exhaust cam shaft including cam lobes adapted to control the at least one exhaust valve, the exhaust cam shaft further adapted to selectively operate the at least one exhaust valve in at least one of a base line mode, an IEGR mode and an EEVO mode; and a control module, the control module adapted to receive a signal indicative of an engine operating temperature and operate the internal combustion engine in the base line mode when the engine temperature exceeds a predetermined IEGR threshold, and to operate the internal combustion engine in both the IEGR mode and the EEVO mode when the engine temperature is less than the predetermined IEGR threshold;

wherein when operating in the base line mode, the exhaust cam shaft is adapted to actuate a primary exhaust valve opening, by fully opening the exhaust valve, during an exhaust event of the exhaust valve's associated cylinder; and when operating in the IEGR mode, the exhaust cam shaft is adapted to actuate a secondary exhaust valve opening, by opening the exhaust valve less than 40% of fully opened, during an intake event of the exhaust valve's associated cylinder, and to hold the exhaust valve partially open between the primary exhaust valve opening and the secondary exhaust valve opening.

10. The internal combustion engine of claim 9, wherein the engine operating temperature is a coolant temperature.

11. The internal combustion engine of claim 9, wherein the engine operating temperature is an exhaust temperature.

12. The internal combustion engine of claim 9, wherein the engine operating temperature is an oil temperature.

13. The internal combustion engine of claim 9, wherein when operating in the EEVO mode, the exhaust cam shaft is adapted to actuate the primary exhaust valve opening prior to the base line primary exhaust valve opening, hold the exhaust valve fully open, and close the exhaust valve according to the base line mode.

14. The internal combustion engine of claim 9, wherein the engine includes an exhaust conduit, and an exhaust manifold coupled to a cylinder head and in communication with the exhaust conduit.

15. The internal combustion engine of claim 14, wherein the engine includes a diesel particulate filter and a selective catalytic reduction catalyst located in the exhaust conduit.

16. The internal combustion engine of claim 15, wherein the diesel particulate filter and the selective catalytic reduction catalyst are combined in a diesel particulate filter/selective catalytic reduction catalyst.

17. The internal combustion engine of claim 16, wherein the engine includes an exhaust gas recirculation unit including an exhaust gas recirculation line, an exhaust gas recirculation cooler, a cooler bypass located in the exhaust gas recirculation line, an exhaust gas recirculation control valve and a backpressure control valve, wherein the exhaust gas recirculation line extends from the exhaust conduit at a location between a turbocharger and an outlet of the exhaust conduit to an intake system to provide communication between the intake system and the exhaust system.

18. The method of claim 7, wherein the engine operating temperature is a coolant temperature.

19. The method of claim 7, wherein the engine operating temperature is an exhaust temperature.

20. The method of claim 7, wherein the engine operating temperature is an oil temperature.

* * * * *